US010894379B2

(12) United States Patent
Schieder

(10) Patent No.: US 10,894,379 B2
(45) **Date of Patent: *Jan. 19, 2021**

(54) GLUE DAM SEAL ASSEMBLY

(71) Applicant: BHS Corrugated Maschinen- und Anlagenbau GmbH, Weiherhammer (DE)

(72) Inventor: Sebastian Schieder, Letzau (DE)

(73) Assignee: BHS Corrugated Maschinen- und Anlagenhau GmbH, Weiherhammer (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/969,271

(22) Filed: May 2, 2018

(65) Prior Publication Data

US 2018/0319118 A1 Nov. 8, 2018

(30) Foreign Application Priority Data

May 3, 2017 (DE) ..... 10 2017 207 396

(51) Int. Cl.
*B05C 1/08* (2006.01)
*B31F 1/28* (2006.01)

(52) U.S. Cl.
CPC ..... *B31F 1/2818* (2013.01); *B05C 1/0826* (2013.01)

(58) Field of Classification Search
CPC ... B05C 1/0826; B05C 11/047; B31F 1/2818; B41F 31/027; B32B 37/0053; B32B 2581/00; B32B 37/1284; B32B 37/1292; B32B 37/20; B29C 65/52; B29C 65/524; B29C 66/83411; Y10T 156/1722; Y10T 156/1724; Y10T 156/1727; Y10T 156/1729; Y10T 156/1741; Y10T 156/1798
USPC ..... 156/470–473
See application file for complete search history.

(56) References Cited

U.S. PATENT DOCUMENTS

| | | | | |
|---|---|---|---|---|
| 5,101,761 | A * | 4/1992 | Isowa | B05C 1/0813 118/249 |
| 9,914,281 | B2 | 3/2018 | Grünwald et al. | |
| 2004/0241328 | A1 | 12/2004 | Bradatsch et al. | |
| 2015/0266257 | A1* | 9/2015 | Grunwald | B05C 1/0826 156/470 |
| 2016/0052249 | A1* | 2/2016 | Saito | B32B 37/0053 156/510 |

FOREIGN PATENT DOCUMENTS

| | | |
|---|---|---|
| DE | 100 17 405 A1 | 10/2001 |
| DE | 103 24 729 A1 | 12/2004 |
| EP | 1 481 793 A2 | 12/2004 |
| EP | 2 921 294 A1 | 9/2015 |

* cited by examiner

*Primary Examiner* — Laura Edwards
(74) *Attorney, Agent, or Firm* — McGlew and Tuttle, P.C.

(57) ABSTRACT

The invention relates to a glue dam seal assembly for a glue application installation of a corrugated board manufacturing device. The glue dam seal assembly comprises a support installation and a first glue dam sealing element for tight disposal on a first roller, which sealing element is disposed on the support installation.

24 Claims, 9 Drawing Sheets

GLUE DAM SEAL ASSEMBLY

This application claims the priority of German Patent Application Serial No. DE 10 2017 207 396.9, filed on May 3, 2017, pursuant to 35 U.S.C. 119(a)-(d), the content of which is incorporated herein by reference in its entirety as if fully set forth herein.

FIELD OF THE INVENTION

The invention relates to a glue dam seal assembly for a glue application installation of a corrugated board plant. The invention furthermore relates to a glue application installation, in particular as a component part of a corrugated board plant, having at least one such glue dam seal assembly.

BACKGROUND OF THE INVENTION

Corrugated board plants of the generic type, or the glue application installations thereof, respectively, are generally known. It is often disadvantageous in the case of these that the glue dam seal assemblies are subject to high wear. Furthermore, the sealing effect and the handling of said glue dam seal assemblies is often not satisfactory.

The invention is therefore based on the object of providing a glue dam seal assembly which has an extremely high sealing effect and long service life. The glue dam seal assembly is furthermore also intended to be particularly user-friendly and easy to handle. A corresponding glue application installation is moreover to be provided.

SUMMARY OF THE INVENTION

This object is achieved according to the invention by a glue dam seal assembly for a glue application installation of a corrugated board plant, the glue dam seal comprising a support installation, and a first glue dam sealing element for tight disposal on a first roller of a glue application installation, which sealing element is disposed on the support installation. This object is further achieved according to the invention by a glue application installation for applying glue to a corrugated material web, the glue application installation comprising a first roller, and at least one glue dam seal assembly according to the invention. The core concept of the invention lies in that the glue dam seal assembly for the first roller comprises an in particular dedicated glue dam sealing element, this leading to an extremely high sealing effect.

The first roller is preferably a glue metering roller or a glue squeegee roller, respectively. Alternatively, said first roller is a glue application roller or a gluing roller, respectively.

The first glue dam sealing element is favourably plate-shaped. Said first glue dam sealing element when in use preferably bears in a sealing manner circumferentially on the first roller, and to this end is preferably adapted to the first roller. The first roller is preferably a glue metering roller.

The support installation is preferably dimensionally stable. It is advantageous for the support installation to be embodied as a formed part, in particular as a sheet-metal part. The support installation is preferably fastenable to the corrugated board production device, or is fastened to the latter, respectively.

The glue application installation serves in particular for gluing a corrugated first material web. Said glue application installation is, for example, a component part of a corrugated board production device for producing a preferably continuous unilaterally laminated corrugated board web. The corrugated board production device favourably comprises a fluting installation for fluting a material web, and the glue application installation. A corrugated board plant preferably comprises at least one corrugated board production device. Alternatively or additionally, a glue application installation serves for gluing an at least two-ply corrugated board web, in particular for gluing the outer corrugated material web of said at least two-ply corrugated board web.

The design embodiment configured such that the first glue dam sealing element has a circular-arc-shaped sealing edge for bearing on the first roller leads to a particularly high sealing effect of the first glue dam sealing element in relation to the first roller. The first sealing edge preferably extends across an angular range between 50° and 120°, more preferably between 65° and 105°. Said first sealing edge when in use favourably bears in a sealing and linear or arcuate, respectively, manner on the first roller across said range.

The first internal bearing clearance of the first glue dam sealing element for mounting the first glue dam sealing element on the support installation is favourably closed at the circumference. Said first bearing clearance is preferably configured as an opening. It is advantageous for the first bearing clearance to be disposed in a first region of the centre of gravity of the first glue dam sealing element.

The first glue dam sealing element, which is capable of being urged in a direction towards a first central axis of the first roller, when in use bears in particular in a uniformly sealing manner circumferentially on the first roller. In particular, a uniform sealing pressure prevails across a sealing region on the first roller, this also resulting in a uniform wear of the first glue dam sealing element.

The first glue dam sealing element, which is pivotable in relation to the support installation, is in particular freely pivotable, or pivotably mounted. It is advantageous for the first glue dam sealing element to be pivotable about a first pivot axis which runs parallel with a first central axis, or rotation axis, respectively, of the first roller.

To this end, a first pivot bearing is favourably present. Said first pivot bearing enables a particularly free-moving pivoting of the first glue dam sealing element, this in turn leading to an extremely high sealing effect.

It is advantageous for the optional second glue dam sealing element, which is disposed on the support installation for tight disposal on a second roller of the glue application installation, to be substantially functionally identical to the first glue dam sealing element. The second glue dam sealing element in terms of the form or the design, respectively, thereof favourably differs from the first glue dam sealing element.

The second glue dam sealing element is favourably plate-shaped.

The second roller is preferably a glue application roller or a gluing roller, respectively. Alternatively, said second roller is, for example, a glue metering roller, or a glue squeegee roller, respectively.

It is expedient for the second glue dam sealing element, which has a circular-arc-shaped termination edge for the spaced-apart disposal from the first roller, when in use to be disposed so as to also be adjacent to the first roller, but favourably so as to be slightly, in particular uniformly, spaced apart from the latter, and to this end to be adapted to the first roller. The first and the second roller preferably run so as to be mutually parallel and are disposed so as to be, in particular slightly, mutually spaced apart from each other.

The design embodiment configured such that the second glue dam sealing element has a circular-arc-shaped sealing edge for bearing on the second roller leads to a particularly high sealing effect of the second glue dam sealing element with respect to the second roller.

The second glue dam sealing element when in use preferably bears in a sealing manner circumferentially on the second roller, and to this end is preferably adapted to the second roller.

The second sealing edge preferably extends across an angular range between 30° and 100°, more preferably between 50° and 80°. Said second sealing edge when in use favourably bears in a sealing and linear or arcuate, respectively, manner on the second roller across said range.

The second internal bearing clearance of the second glue dam sealing element for mounting the second glue dam sealing element on the support installation is favourably closed at the circumference. Said second bearing clearance is preferably configured as an opening. It is advantageous for the second bearing clearance to be disposed in a second region of the centre of gravity of the second glue dam sealing element.

The second glue dam sealing element, which is capable of being urged in a direction towards a second central axis of the second roller, when in use bears in particular in a uniformly sealing manner circumferentially on the second roller. In particular, there is a uniform sealing pressure across a sealing region on the second roller, this also resulting in uniform wear of the second glue dam sealing element.

The second glue dam sealing element, which is pivotable in relation to the support installation, is in particular freely pivotable, or pivotably mounted. It is advantageous for the second glue dam sealing element to be pivotable about a second pivot axis which runs parallel with a second central axis, or rotation axis, respectively, of the second roller.

To this end, a second pivot bearing is favourably present. Said second pivot bearing permits a particularly free-moving pivoting of the second glue dam sealing element, this in turn leading to an extremely high sealing effect.

The design embodiment configured such that the first glue dam sealing element and the second glue dam sealing element are disposed so as to be mutually spaced apart from each other permits an unencumbered adjustment of the glue dam sealing elements.

The relative and, in particular, pivotable adjustment of the first glue dam sealing element and the second glue dam sealing element to one another is performed by way of the first and/or second glue dam sealing element.

The first and/or second glue dam sealing element is preferably capable of being urged onto the first or second roller, respectively, by means of a respective urging installation.

An urging element of the urging installation is favourably embodied as a pivoting-force transmission element, or is embodied so as to be rigid, respectively. Said urging element is preferably embodied as a contact pressure element for pressing the respective glue dam sealing element in a sealing manner onto the respective roller. Alternatively, said urging element is a traction element for drawing the respective glue dam sealing element in a sealing manner onto the respective roller.

The urging element and the associated glue dam sealing element are preferably, in particularly freely, or in an unimpeded manner, respectively, pivotable in relation to one another at least across a pivoting region. A first glue dam sealing element of this type is in particular capable of pivoting in a self-acting manner about the pivot axis, this at all times permitting an automatic adaptation to the roller and thus leading to a particularly high sealing effect and easy handling. This is particularly advantageous in the case of an adjustment of the respective roller.

A respective pivoting installation is preferably capable of pivoting the urging element.

An urging spring element of the pivoting installation is embodied, for example, as a compression spring element or a tension spring element. It is advantageous for the urging spring element to be embodied, for example, as a spring, an elastic/resilient material member, or the like.

According to one preferred embodiment, a plurality of urging spring elements are present. Said plurality of urging spring elements in this instance favourably engage on the urging element in a circumferential direction of the urging element so as to be mutually spaced apart from each other. It is advantageous for between three and six urging spring elements to be present in this instance.

The urging spring element exerts a pivoting moment on the urging element, this ultimately causing a resulting urging force acting on the respective glue dam sealing element.

The urging element, according to one preferred embodiment, is mounted so as to be eccentric on the support installation.

According to one preferred embodiment, the urging element is of the lever type. It is advantageous for a pivot axis of the urging element to be disposed between an engagement point of an urging spring element on the urging element and an articulation point of the glue dam sealing element on the urging element.

A pivot motor of an alternative pivoting installation is favourably of the pneumatic, hydraulic, and/or electrical type.

Three preferred embodiments of the invention will be described in an exemplary manner hereunder with reference to the appended drawing.

DESCRIPTION OF THE PREFERRED EMBODIMENTS

Figure 1:
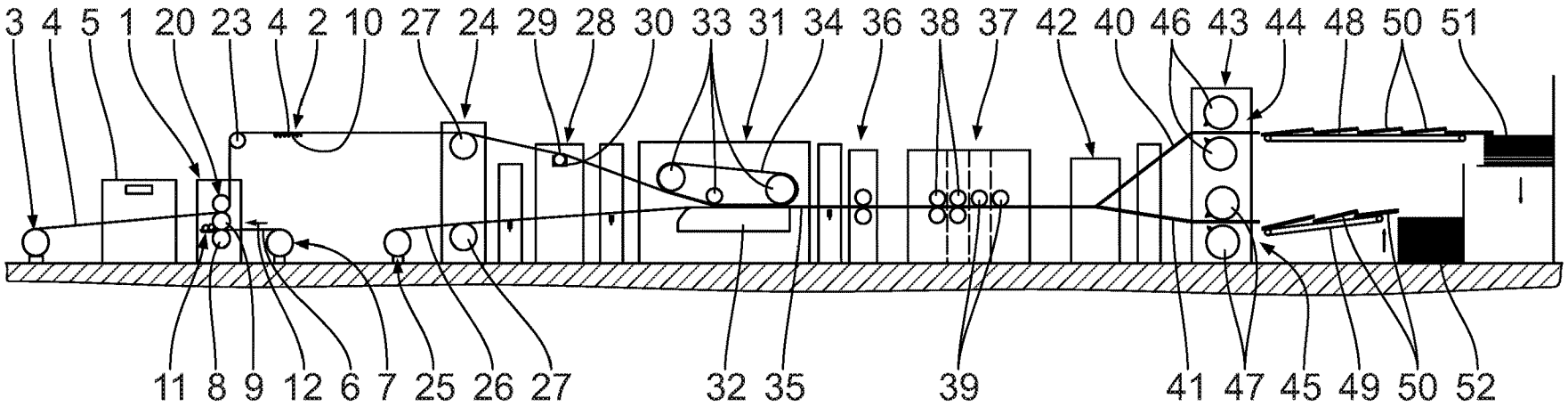
FIG. 1 shows a simplified lateral view of a corrugated board plant having a corrugated board production device according to the invention.

A corrugated board plant as is schematically illustrated in its entirety in FIG. 1 comprises a corrugated board production device 1 for producing a continuous unilaterally laminated corrugated board web 2.

A preferably continuous first material web 4 is fed to the corrugated board production device 1 from a first unwinding installation 3 by way of a preheating installation 5. The first material web 4 represents a cover web for the unilaterally laminated corrugated board web 2 produced in the corrugated board production device 1.

The first material web 4 is combined in the corrugated board production device 1 with a preferably continuous second material web 6 which is unwound from a second unwinding installation 7.

For producing a corrugation, in the corrugated board production device 1 the second material web 6 is guided through a corrugated roller pair which comprises a lower or first, respectively, corrugated roller 8 and an upper or second, respectively, corrugated roller 9. The second material web 6 after this passage through the corrugated roller pair is present as the corrugated web 10. The corrugated web 10 has alternating flute tips and flute troughs.

The flute tips of the corrugated web 10 are subsequently glued in a glue application installation 11 of the corrugated board production device 1. The glue application installation 11 in a transport direction 12 of the second material web 6 is disposed so as to be downstream of a corrugation gap that is configured by the corrugated rollers 8, 9.

Figure 2:
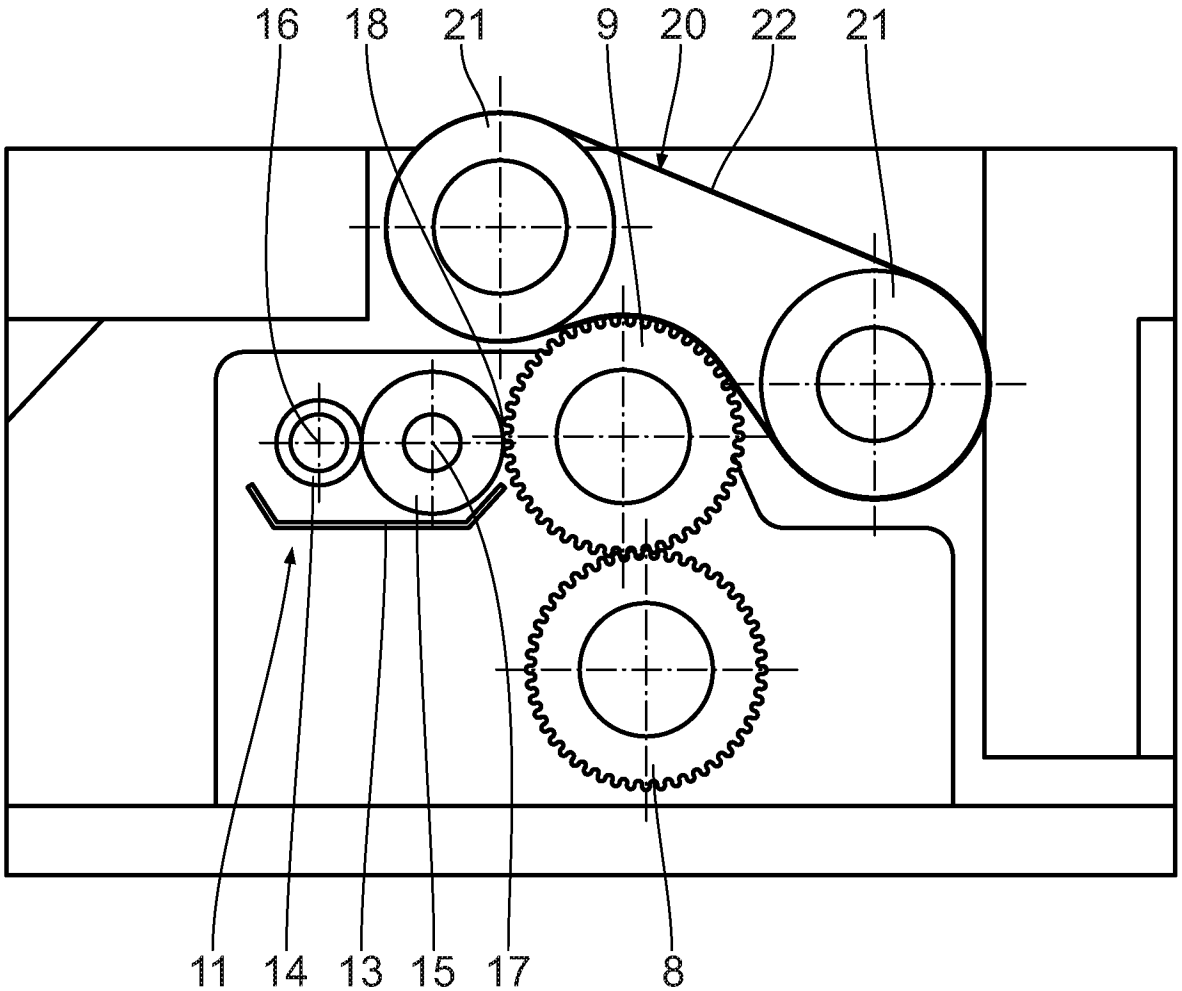
FIG. 2 shows a simplified lateral view of a corrugated board production device according to the invention, having a glue application installation, the contact pressure installation of said corrugated board production device being configured differently from that in FIG. 1.

As is shown in FIG. 2, the glue application installation 11 comprises a glue tank 13 and a glue metering roller 14 as well as a glue application roller 15. The glue application roller 15 is disposed between the glue metering roller 14 and the second corrugated roller 9.

The glue metering roller 14 and the glue application roller 15 are mounted in lateral walls of the glue tank 13. The glue metering roller 14 is mounted so as to be rotatable, or capable of being rotatably driven, respectively, about a first rotation axis 16, while the glue application roller 15 is mounted so as to be rotatable, or capable of being rotatably driven, respectively, about a second rotation axis 17. The rotation axes 16, 17 run so as to be mutually parallel and also so as to be parallel with the corrugated roller rotation axes of the corrugated rollers 8, 9.

In order for the corrugated web 10 to be passed through and glued, the glue application roller 15 conjointly with the second corrugated roller 9 forms a roller gap, or a glue gap 18, respectively. Glue located in the glue tank 13, by way of the glue application roller 15 that is submerged therein and rotates about the second rotation axis 17, is applied to the free flute tips of the transported corrugated web 10 which bears there on the second corrugated roller 9.

The glue metering roller 14 is disposed so as to be substantially opposite the second corrugated roller 9 and adjacent to the glue application roller 15, and serves for configuring a uniform glue layer on the glue application roller 15. The glue metering roller 14 favourably forms a glue squeegee roller and to this end bears circumferentially on the glue application roller 15. Said glue metering roller 14 when in use rotates about the first rotation axis 16 thereof and is preferably submerged in the glue.

The glue metering roller 14 and the glue application roller 15 when in operation are rotatably driven by way of at least one drive (not illustrated).

Figure 3:
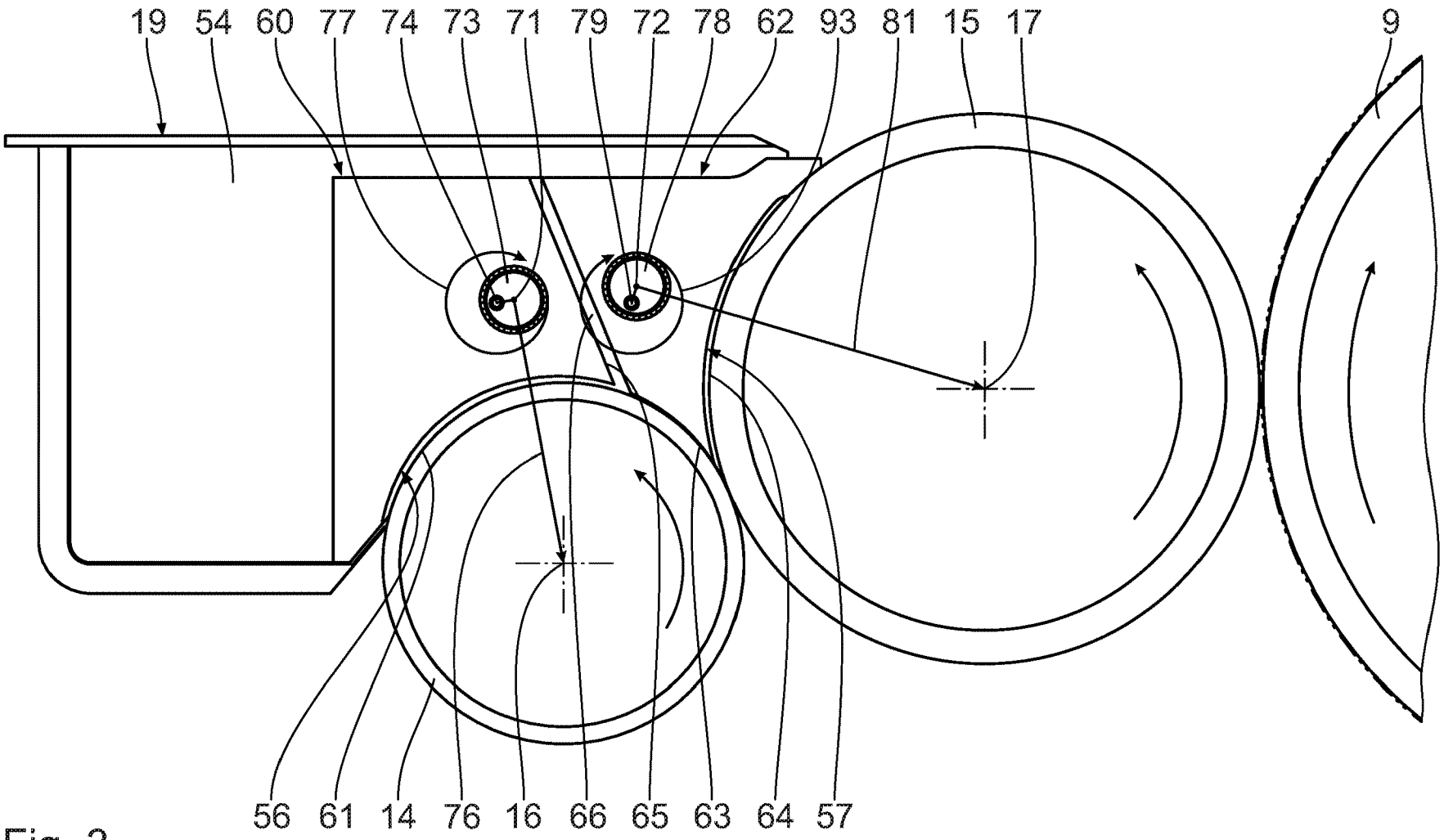
FIG. 3 shows an enlarged lateral view of the glue application installation portrayed in FIG. 2, wherein a glue dam seal assembly having glue dam sealing elements which bear in a sealing manner on the rollers of the glue application installation is also conjointly illustrated.
Figure 4:
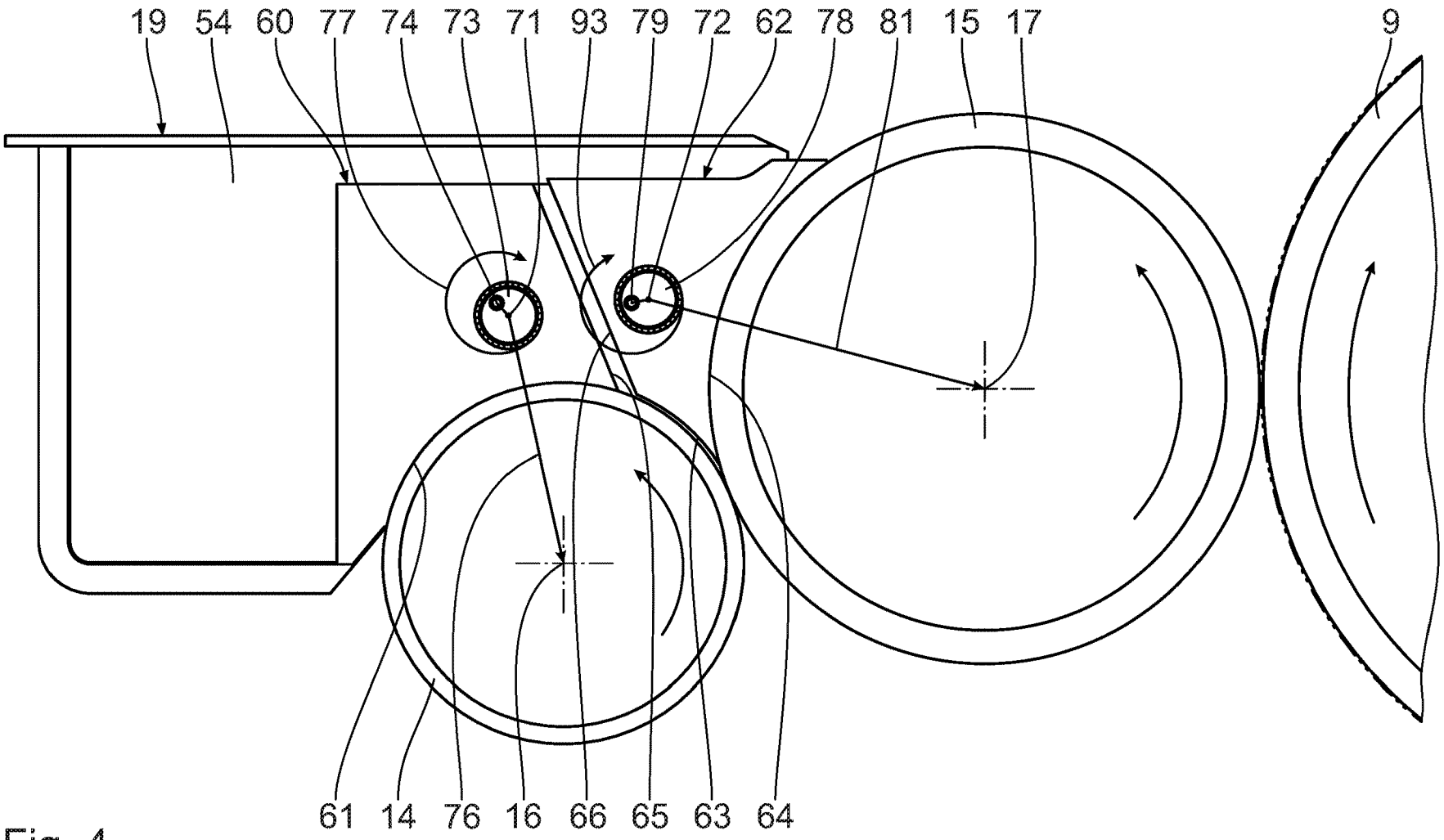
FIG. 4 shows a view corresponding to that of FIG. 3, wherein the glue dam sealing elements are illustrated in a worn state.
Figure 5:
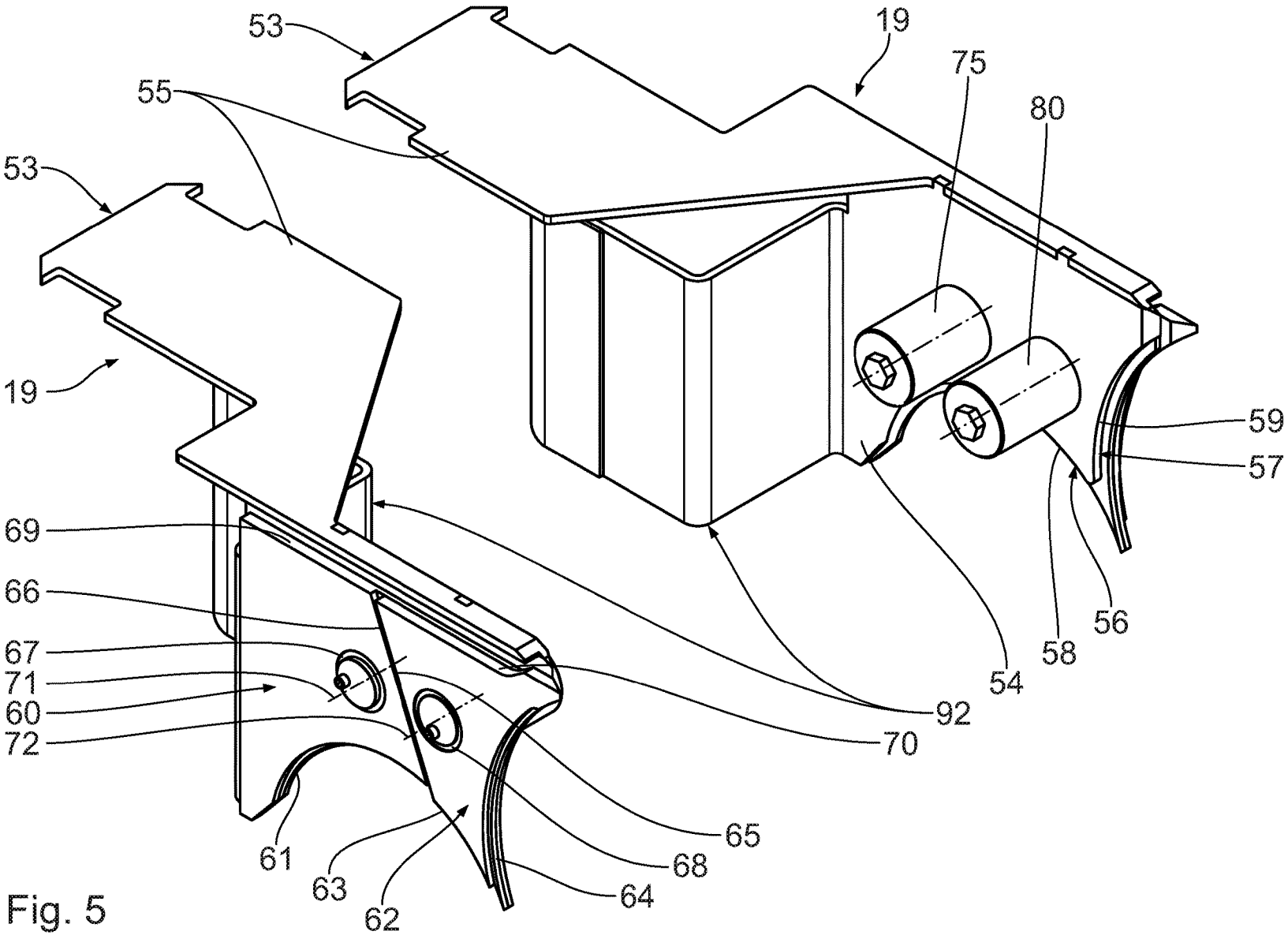
FIG. 5 shows a perspective view of the glue dam seal assemblies according to FIG. 4.

As is shown in FIGS. 3 to 5, the glue application installation 11 furthermore has two glue dam seal assemblies 19 which serve for delimiting the glue in the glue tank 13 and setting a gluing region of the corrugated web 10. This is to be discussed in yet more detail hereunder.

The corrugated web 10 provided with glue is subsequently combined with the transported first material web 4 in the corrugated board production device 1, so as to obtain the unilaterally laminated corrugated board web 2. In order for the first material web 4 to be pressed against the corrugated web 10 which is provided with glue and there in regions bears on the second corrugated roller 9, the corrugated board production device 1 has a contact pressure installation 20. The contact pressure installation 20 is embodied according to FIG. 1 as a contact pressure roller, while said contact pressure installation 20 is configured according to FIG. 2 as a contact pressure belt module having two contact pressure rollers 21 and a contact pressure belt 22 that is guided around said two contact pressure rollers 21. The contact pressure installation 20 in relation to the corrugated web 10 is disposed so as to be downstream of the roller gap 18.

The unilaterally laminated corrugated board web 2 that is formed from the first material web 4 and the second material web 6/corrugated web 10 is then guided out of the corrugated board production device 1 and guided around a deflection roller 23 to a preheating assembly 24 of the corrugated board plant.

The corrugated board plant moreover has a third unwinding installation 25 for a preferably continuous third material web 26. The third material web 26 forms a lamination web for the unilaterally laminated corrugated board web 2. Said third material web 26 is likewise fed to the preheating assembly 24.

The unilaterally laminated corrugated board web 2 and the third material web 26 are heated in the preheating assembly 24. The preheating assembly 24 to this end has two heatable heating rollers 27 which are contacted by the unilaterally laminated corrugated board web 2 and the third material web 26.

The corrugated board plant furthermore comprises a gluing unit 28 which is disposed downstream of the preheating assembly 24 and forms a further glue application installation. The gluing unit 28 has a gluing roller, or glue application roller 29, respectively, which partially plunges into a glue bath 30. The unilaterally laminated corrugated board web 2 by way of the corrugated web 10 thereof is in contact with the gluing roller 29 such that glue from the glue bath 30 is transferred to the flute tips of the corrugated web 10.

Furthermore, the gluing unit 28 according to a preferred embodiment comprises a glue squeegee roller, or glue metering roller, respectively, (not illustrated) which is assigned to the gluing roller 29 and runs so as to be parallel with the latter.

The gluing unit 28 preferably has two corresponding glue dam seal assemblies 19 (not illustrated).

The glue dam seal assemblies 19 can be present in the gluing unit 28 and/or the glue application installation 11 of the corrugated board production device 1.

The corrugated board plant moreover has a heat compression installation 31 which is disposed downstream of the gluing unit 28. The heat compression installation 31 comprises a horizontal table 32, provided with heating elements (not illustrated), and a continuous contact pressure belt 34 that is guided around rollers 33. A contact pressure gap through which the unilaterally laminated corrugated board web 2 and the third material web 26 are transported and in which they are pressed against one another is formed between the contact pressure belt 34 and the table 32. A three-ply continuous corrugated board web 35 is formed in the heat compression installation 31.

A short transverse cutting device 36 of the corrugated board plant is disposed downstream of the heat compression installation 31. The three-ply corrugated board web 35 is guided through the short transverse cutting device 36. The short transverse cutting device 36 serves for reliably removing any start-up waste from the three-ply corrugated board web 35, on the one hand, and for carrying out application or format changes, respectively, on the three-ply corrugated board web 35, on the other hand.

The corrugated board plant, downstream of the short transverse cutting device 36, has a longitudinal cutting/corrugating device 37 having two corrugating stations 38, and two longitudinal cutting stations 39 which are disposed behind one another. The three-ply corrugated board web 35 is guided through the longitudinal cutting/corrugating device 37. The three-ply corrugated board web 35 is capable of being corrugated by the corrugating stations 38, while the three-ply corrugated board web 35 is capable of being split by the longitudinal cutting stations 39 into a plurality of continuous corrugated board part-webs 40, 41. The corrugated board part-webs 40, 41 are initially conveyed so as to still be in parallel beside one another.

The corrugated board plant, downstream of the longitudinal cutting/corrugating device 37, has a turnout 42 which serves for transporting the corrugated board part-webs 40, 41 in different planes. The corrugated board plant, downstream of the turnout 42, has a transverse cutting device 43 having two partial transverse cutting installations 44, 45 that are disposed on top of one another. Each partial transverse cutting installation 44, 45 has two transverse cutting rollers 46, 47 that are disposed on top of one another in pairs. The upper partial transverse cutting installation 44 is disposed above the lower partial transverse cutting installation 45 and serves for transversely severing the upper corrugated board part-web 40. The lower partial transverse cutting installation 45 serves for transversely severing the lower corrugated board part-web 41.

A conveyor belt 48, 49 of the corrugated board plant is disposed downstream of each partial transverse cutting installation 44, 45, so as to feed corrugated board sheets 50 that are generated from the corrugated board part-webs 40, 41 by the partial transverse cutting installations 44, 45 to stack depositing devices 51, 52 of the corrugated board plant.

Various three-ply corrugated board webs 35 are producible in the corrugated board plant. Said three-ply corrugated board webs 35 can differ from one another, for example, in the transverse width thereof. To this end, unilaterally laminated corrugated board webs 2 that are adapted in a corresponding manner are already generated in the corrugated board production device 1.

In order for dissimilar width regions, or transverse regions, respectively, of the corrugated web 10 to be glued in the corrugated board production device 1, the glue dam seal assemblies 19 are displaceable independently of one another in a transverse direction of the corrugated web 10. The glue dam seal assemblies 19 are thus displaceable along the first rotation axis 16, or the second rotation axis 17, respectively, of the glue metering roller 14, or of the glue application roller 15, respectively. For example, a glue width on the corrugated web 10, or a spacing of a glue region on the corrugated web 10 from the longitudinal peripheries of the glue dam seal assemblies 19, respectively, is settable by way of this displacement of the glue dam seal assemblies 19. The glue dam seal assemblies 19 are thus adaptable in terms of their position, or in terms of their mutual spacing, respectively, to the corrugated web 10 to be glued. The displacement can be performed manually or in a motorized manner.

The glue dam seal assemblies 19 are identical in terms of construction and are mutually symmetrical.

As is shown in FIG. 5, each glue dam seal assembly 19 has a support installation 53 having a main support body 92 and a lateral support body 54, adjoining the latter, and a head element 55 which adjoins the respective main support body 92 and lateral support body 54 at the top.

Each lateral support body 54 is plate-like and in the assembled state of the glue dam seal assembly 19 extends perpendicularly to the corrugated web 10, or to the rotation axes 16, 17, respectively. Each lateral support body 54 has a glue metering roller receptacle 56 that is adapted to the glue metering roller 14, and a glue application roller receptacle 57 that is adapted to the glue application roller 15 and is disposed so as to be adjacent to said glue metering roller receptacle 56. The glue metering roller receptacle 56 is delimited by an arcuate, in particular a circular-arc-shaped, metering roller receptacle edge 58, while the glue application roller receptacle 57 is delimited by an arcuate, in particular circular-arc-shaped, glue application roller receptacle edge 59.

In the assembled state, or when in use, respectively, the glue metering roller 14 engages in the glue metering roller receptacle 56 of the glue dam seal assemblies 19, while the glue application roller 15 engages in the glue application roller receptacle 57 of the glue dam seal assemblies 19 (FIGS. 3, 4). The glue dam seal assemblies 19 in this instance are opposite one another and delimit the glue in the glue tank 13 along the rotation axes 16, 17.

Furthermore, each glue dam seal assembly 19 comprises a first glue dam sealing element 60 which is disposed, or guided, respectively, so as to be displaceable on the respective lateral support body 54. Each first glue dam sealing element 60 is embodied in the manner of a plate and has an arcuate, in particular circular-arc-shaped, glue metering roller sealing edge 61 that is adapted to the glue metering roller 14 and in a sealing position of the respective glue dam seal assembly 19 bears in a sealing manner circumferentially on the glue metering roller 14.

Each glue dam seal assembly 19 furthermore has a second glue dam sealing element 62 which is disposed so as to be adjacent to the associated first glue dam sealing element 60 and is disposed, or guided, respectively, so as to be displaceable on the respective lateral support body 54. Each second glue dam sealing element 62 is embodied in the manner of a plate. Each second glue dam sealing element 62 has an arcuate, in particular circular-arc-shaped, glue metering roller termination edge 63 that is adapted to the glue metering roller 14, and an arcuate, in particular circular-arc-shaped, glue application roller sealing edge 64 that is adapted to the glue application roller 15. The first glue dam sealing element 60 and the second glue dam sealing element 62 in a sealing position of the respective glue dam seal assembly 19 lie in a common plane. Said first glue dam sealing element 60 and said second glue dam sealing element 62 are favourably disposed so as to be mutually spaced apart from each other. The glue metering roller termination edge 63 runs so as to be slightly spaced apart from the glue metering roller 14 (spaced apart by 0.1 mm to 0.3 mm), while the glue application roller sealing edge 64 bears in a sealing manner circumferentially on the glue application roller 15. The glue metering roller sealing edge 61 and the glue metering roller termination edge 63 of the respective glue dam seal assembly 19, in the sealing positions of the glue dam sealing elements 60, 62, favourably transition into one another in a substantially seamless manner. Said glue metering roller sealing edge 61 and said glue metering roller termination edge 63 in this instance virtually form a common arcuate, in particular circular-arc-shaped, glue metering roller edge.

The first and the second glue dam sealing element 60, 62 of each glue dam seal assembly 19 are adjustable independently of one another along the adjacent lateral support body 54.

The first glue dam sealing element 60 has a first lateral edge 65 which adjoins the glue metering roller sealing edge 61 and faces the adjacent second glue dam sealing element 62. The second glue dam sealing element 62 has a second lateral edge 66 which adjoins the glue metering roller termination edge 63 and faces the first lateral edge 65, or the first glue dam sealing element 60, respectively. The lateral edges 65, 66 extend in a straight manner. Said lateral edges 65, 66 run so as to be inclined in relation to a vertical and in relation to the latter enclose an angle between 5° and 45°, more preferably between 10° and 30°. Said lateral edges 65, 66 are inclined from above in the direction towards the glue application roller 15.

A circular first bearing opening, or bearing clearance 67, respectively, is disposed in each first glue dam sealing element 60 so as to be adjacent to the first lateral edge 65, while a circular second bearing opening, or bearing clearance 68, respectively, is disposed in each second glue dam sealing element 62 so as to be adjacent to the second lateral edge 66. The bearing openings 67, 68 in the assembled state of the respective glue dam seal assembly 19 are disposed at a substantially common height and have a substantially identical spacing from an upper first top edge 69 and an upper second top edge 70 of the first glue dam sealing element 60, or of the second glue dam sealing element 62, respectively. Said bearing openings 67, 68 preferably have an identical diameter.

The bearing openings 67, 68 are closed on the circumference. Each first bearing opening 67 has a first central axis 71, while each second bearing opening 68 has a second central axis 72. The central axes 71, 72 extend so as to be mutually parallel. Said central axes 71, 72 run parallel with the first and the second rotation axis 16, 17. The central axes 71, 72 are disposed so as to be spaced apart from the first and the second top edge 69, 70, respectively, and from the (sealing) edges 61, 63 or 64, respectively.

Each glue dam seal assembly 19 has a circular first contact pressure element 73 which is received in the first bearing opening 67 and has a first diameter. The first diameter of the first contact pressure element 73 is smaller, favourably slightly smaller, than the first diameter of the first bearing opening 67 such that there is play between the first contact pressure element 73 and the first glue dam sealing element 60. Each first contact pressure element 73 is pivotable about a first pivot axis 74 which runs so as to be eccentric in relation to the first contact pressure element 73, or the first central axis 71, respectively, and parallel with the rotation axes 16, 17. A first contact pressure cam is thus formed.

Each first contact pressure element 73 by way of a corresponding first pivoting means 75 is pivotable about the respective first pivot axis 74, said first pivoting means 75 being fastened, in particular on the internal side, on the adjacent lateral support body 54, and here being embodied as a motor or drive, respectively.

Each first pivoting means 75 when in operation pivots the corresponding assigned first contact pressure element 73 about the respective first pivot axis 74, this leading to a lateral displacement of the first contact pressure element 73 and to a corresponding displacement of the assigned first glue dam sealing element 60 by way of the first contact pressure element 73 which engages internally in the first bearing opening 67 on the first glue dam sealing element 60.

Each first contact pressure element 73, in the operation/use of the first pivoting means 75, is capable of exerting a resulting first contact pressure force 76 on the first glue dam sealing element 60, said first contact pressure force 76 being directed exactly onto the first rotation axis 16 of the glue metering roller 14. Each first contact pressure element 73 herein is pivoted in a first pivoting direction 77 about the associated first pivoting axis 74. Each first glue dam sealing element 60 is at all times pivotable in an unimpeded manner about the assigned first contact pressure element 73, in particular substantially about the central axis 71 of the latter.

Each glue dam seal assembly 19 furthermore has a circular second contact pressure element 78 which is received in the second bearing opening 68 and has a second diameter. The second diameter of the second contact pressure element 78 is smaller, favourably slightly smaller, than the second diameter of the second bearing opening 68 such that there is play between the second contact pressure element 78 and the second glue dam sealing element 62. Each second contact pressure element 78 is pivotable about a second pivot axis 78 which is parallel with the first pivot axis 74 and runs so as to be eccentric in relation to the second contact pressure element 78, or the second central axis 72, respectively, and parallel with the rotation axes 16, 17. A second contact pressure cam is thus formed.

Each second contact pressure element 78 by way of a corresponding second pivoting means 80 is pivotable about the respective second pivot axis 79, said second pivoting means 80 being fastened, in particular on the internal side, on the adjacent lateral support body 54, and here being embodied as a motor or drive, respectively.

Each second pivoting means 80 when in operation pivots the corresponding assigned second contact pressure element 78 about the respective second pivot axis 79, this leading to a lateral displacement of the second contact pressure element 78 and to a corresponding displacement of the assigned second glue dam sealing element 62 by way of the second contact pressure element 78 which engages internally in the second bearing opening 68 on the second glue dam sealing element 62.

Each second contact pressure element 78, in the operation/use of the second pivoting means 80, is capable of exerting a resulting second contact pressure force 81 on the second glue dam sealing element 62, said second contact pressure force 81 being directed exactly onto the second rotation axis 17 of the glue application roller 15, and thus running obliquely to the resulting first contact pressure force 76. Each second contact pressure element 78 herein is pivoted in a second pivoting direction 93 about the associated second pivoting axis 79. Each second glue dam sealing element 62 is at all times pivotable in an unimpeded manner about the assigned second contact pressure element 78, in particular substantially about the central axis 72 of the latter.

As is shown in FIG. 3, the glue metering roller sealing edge 61 is disposed in a sealing manner circumferentially on the glue metering roller 14, such that the first glue dam sealing element 60 seals in relation to the glue metering roller 14. The first pivot axis 74 is located laterally approximately at the height of the first central axis 71 of the first contact pressure element 73. The first glue dam sealing element 60 is in a new, non-worn state.

According to FIG. 3, the glue metering roller termination edge 63 is disposed so as to be slightly spaced apart from the glue metering roller 14.

The glue application roller sealing edge 64 is disposed in a sealing manner circumferentially on the glue application roller 15, such that the glue application roller sealing edge 64 seals in relation to the glue application roller 15. The second pivot axis 79 is located in a lower region of the second bearing opening 68.

Pivoting of the first contact pressure element 73 in the first pivoting direction 77 about the first pivot axis 74 by the respective first pivoting means 75 leads to the resulting first contact pressure force 76, directed in the direction towards the first rotation axis 16, being exerted on the first glue dam sealing element 60, this leading to a displacement of the first glue dam sealing element 60 in the direction towards the first rotation axis 16 of the glue metering roller 14, and ultimately to a uniform, tight bearing of the glue metering roller sealing edge 61 on the glue metering roller 14. This holds true also in a worn state of the first glue dam sealing element 60. The first pivot axis 74 in this instance is in an upper region of the first bearing opening 67 (FIG. 4).

Pivoting of the second contact pressure element 78 in the second pivoting direction 93 about the second pivot axis 79 by the respective second pivoting means 80 leads to the resulting second contact pressure force 81, directed in the direction towards the second rotation axis 17, being exerted on the second glue dam sealing element 62, this leading to a displacement of the second glue dam sealing element 62 in the direction towards the second rotation axis 17 of the glue application roller 15, and ultimately to a uniform tight bearing of the glue application roller sealing edge 64 on the glue application roller 15. This holds true also in a worn state of the second glue dam sealing element 62. The second pivot axis 79 in this instance is located approximately at the height of the second central axis 72 of the second contact pressure element 78 (FIG. 4).

A first contact pressure installation comprises a first contact pressure element 73 and a first pivoting means 75. A second contact pressure installation comprises a second contact pressure element 78 and a second pivoting means 80.

The same applies in an analogous manner to the use of the glue dam seal assemblies 19 in the gluing unit 28. When the gluing unit 28 comprises only the gluing roller 29 as a roller, each glue dam seal assembly 19 thus has only one first or second glue dam sealing element 60, 62, and only one contact pressure installation. When the gluing unit 28 comprises the gluing roller 29 and the glue squeegee roller, each glue dam seal assembly 19, as is the case in the glue application installation 11 of the corrugated board production device 1, thus has two glue dam sealing elements 60, 62 and two contact pressure installations.

A second embodiment will be described hereunder with reference to FIGS. 6, 7. Parts of identical construction are assigned the same reference signs as is the case in the previous embodiment, reference being explicitly made to the description thereof. Parts of dissimilar construction which are, however, functionally equivalent are assigned the same reference signs with the suffix "a".

In contrast to the first embodiment, each first bearing opening 67*a* is embodied in an elongate manner and extends substantially parallel with an adjacent tangent of the glue metering roller sealing edge 61. Each first bearing opening 67*a* preferably extends so as to be slightly inclined in relation to a horizontal.

Each first contact pressure element 73*a* is embodied in the manner of a lever and is pivotable about the first pivot axis 74 which again extends so as to be parallel with the first rotation axis 16 of the glue metering roller 14. Each first contact pressure element 73*a* is mounted so as to be pivotable on the adjacent lateral support body 54, a corresponding cylindrical first bearing pin 82 being disposed to this end on the latter.

A first pivoting means 75*a* which is formed by a first compression spring, in particular a coil compression spring, engages on each first contact pressure element 73*a* at a spacing from each first pivot axis 74. Each first pivoting means 75*a* is supported at the bottom on the first glue dam sealing element 60*a*.

Each first glue dam sealing element 60*a* by way of a cylindrical first coupling pin 83 is pivotably connected to the assigned first contact pressure element 73*a*. Each first coupling pin 83 is favourably disposed on the respective first glue dam sealing element 60*a*. Each first bearing pin 82 is disposed between the first coupling pin 83 and a first engagement point 84 of the first pivoting means 75*a* on the first contact pressure element 73*a*.

The first glue dam sealing element 60*a* is capable of at all times adapting in a self-acting manner to the glue metering roller 14, or by way of the glue metering roller sealing edge 61 thereof of at all times bearing tightly circumferentially on said glue metering roller 14, respectively. Said first glue dam sealing element 60*a* is capable of performing at the same time in a self-acting manner an adjustment of the glue metering roller 14.

Figure 6:
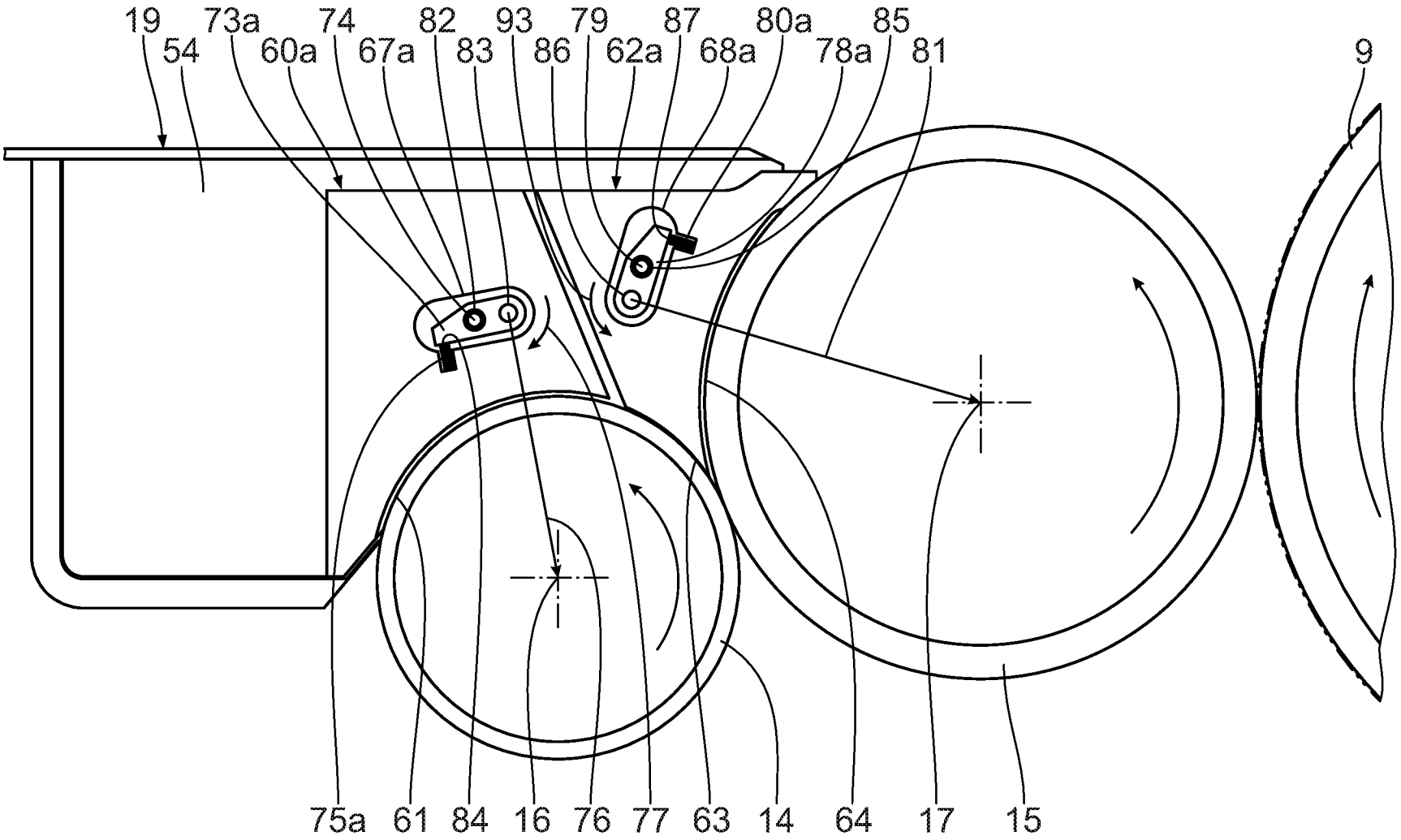
FIG. 6 shows a simplified lateral view corresponding to that of FIG. 3 of a glue application installation according to the invention, according to a second embodiment.
Figure 7:
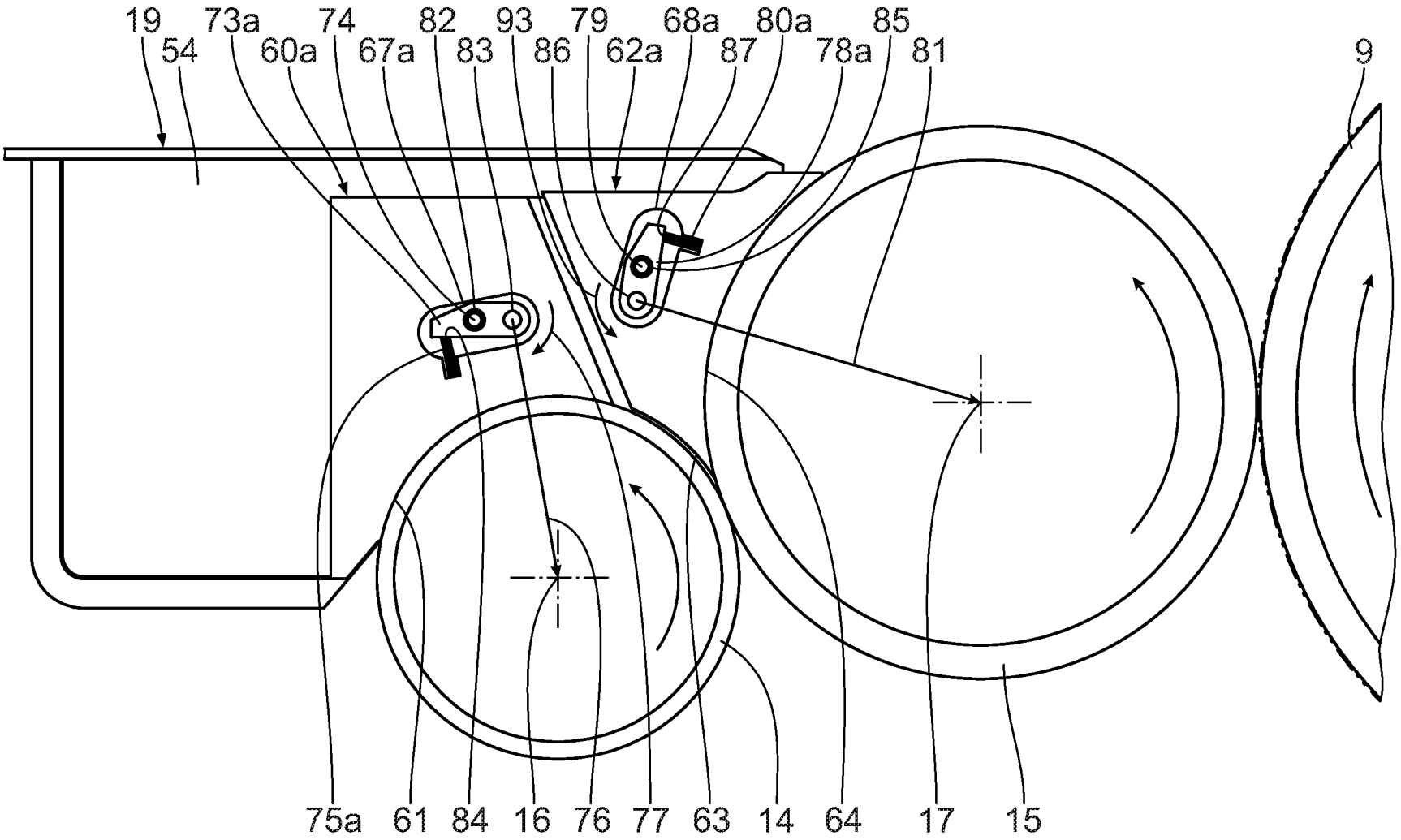
FIG. 7 shows a lateral view corresponding to that of FIG. 6, wherein the glue dam sealing elements are illustrated in a worn state.

As is shown in FIG. 6, the glue metering roller sealing edge 61 is disposed in a sealing manner circumferentially on the glue metering roller 14, such that the first glue dam sealing element 60*a* seals in relation to the glue metering roller 14. The first glue dam sealing element 60*a* is in a new, non-worn state.

According to FIG. 6, the glue metering roller termination edge 63 is disposed so as to be slightly spaced apart from the glue metering roller 14. The glue application roller sealing edge 64 is disposed in a sealing manner circumferentially on the glue application roller 15 such that the glue application roller sealing edge 64 seals in relation to the glue application roller 15.

The first pivoting means 75*a* at the first engagement point 84 at all times presses the first contact pressure element 73*a* upwards, or away from the glue metering roller 14, respectively. On account thereof, the first coupling pin 83, together with the first glue dam sealing element 60*a* sitting thereon, is pressed in the direction towards the first rotation axis 16 of the glue metering roller 14, this leading to a uniform tight bearing of the glue metering roller sealing edge 61 on the glue metering roller 14 (FIG. 7). This holds true also in a worn state of the first glue dam sealing element 60*a*. The resulting first contact pressure force 76 in the direction towards the first rotation axis 16 is generated herein. The first glue dam sealing element 60*a* is disposed so as to be at all times pivotable on the first coupling pin 83.

In contrast to the first embodiment, each second bearing opening 68*a* is embodied in an elongate manner and extends substantially parallel with an adjacent tangent of the glue application roller sealing edge 64. Each second bearing opening 68*a* runs so as to be substantially slightly inclined in relation to a vertical.

Each second contact pressure element 78*a* is embodied in the manner of a lever and is pivotable about the second pivot axis 79 which again extends parallel with the second rotation axis 17 of the glue application roller 15. Each second contact pressure element 78*a* is mounted so as to be pivotable on the adjacent lateral support body 54, a corresponding cylindrical second bearing pin 85 being disposed to this end on the latter.

A second pivoting means 80*a* which is formed by a second compression spring, in particular a coil compression spring, engages on each second contact pressure element 78*a* at a spacing from each second pivot axis 79. Each second pivoting means 80*a* is supported at the bottom on the second glue dam sealing element 62*a*.

Each second glue dam sealing element 62*a* by way of a cylindrical second coupling pin 86 is pivotably connected to the assigned second contact pressure element 78*a*. Each second coupling pin 83 is favourably disposed on the respective second glue dam sealing element 62*a*. Each second bearing pin 85 is disposed between the second coupling pin 86 and a second engagement point 87 of the second pivoting means 80*a* on the second contact pressure element 78*a*.

The second glue dam sealing element 62*a* is capable of at all times adapting in a self-acting manner to the glue application roller 15, or by way of the glue application roller sealing edge 64 thereof of at all times bearing tightly circumferentially on said glue application roller 15, respectively. Said second glue dam sealing element 62*a* is capable of performing at the same time in a self-acting manner an adjustment of the glue application roller 15.

The second pivoting means 80*a* at the second engagement point 87 at all times presses the second contact pressure element 78*a* away from the glue application roller 15. On account thereof, the second coupling pin 86, together with the second glue dam sealing element 62*a* sitting thereon, is pressed in the direction towards the second rotation axis 17 of the glue application roller 15, this leading to a uniform tight bearing of the glue application roller sealing edge 64 on the glue application roller 15 (FIG. 7).

This holds true also in a worn state of the second glue dam sealing element 62*a*. The resulting second contact pressure force 81 in the direction towards the second rotation axis 17 is generated herein. The second glue dam sealing element 62*a* is disposed so as to be at all times pivotable on the second coupling pin 86.

The same applies in an analogous manner to the use of the glue dam seal assemblies 19*a* in the gluing unit 28.

A third embodiment will be described hereunder with reference to FIGS. 8, 9. Parts of identical construction are assigned the same reference signs as is the case in the previous embodiments, reference being explicitly made to the description thereof. Parts of dissimilar construction which are, however, functionally equivalent are assigned the same reference signs with the suffix "b".

As compared with the first embodiment, the first and the second bearing openings 67*b*, 68*b* are embodied differently here. Each first bearing opening 67*b* is non-circular. Each first bearing opening 67*b* is delimited by external first support faces 88 which extend perpendicularly or obliquely in relation to a first circumferential direction of the first bearing opening 67*b*.

Each first contact pressure element 73*b* is disc-like and on the circumference has first engagement faces 90. Each first contact pressure element 73*b* by way of the first bearing pin 82 is mounted on the respective lateral support body 54 so as to be pivotable about a first pivot axis 74. Each first bearing pin 82 is disposed so as to be eccentric to the first contact pressure element 73*b*, or to the central axis 71*b* of the latter, respectively. Each first contact pressure element 73*b* forms a first contact pressure cam.

In each case one first pivoting means 75*b* in the form of a compression spring, in particular in the form of a coil compression spring, is located between a first support face 88 and an adjacent first engagement face 90.

Each second bearing opening 68*b* is non-circular. Each second bearing opening 68*b* is delimited by external second support faces 89 which extend perpendicularly or obliquely to a second circumferential direction of the second bearing opening 68*b*.

Each second contact pressure element 78*b* is disc-like and on the circumference has second engagement faces 91. Each second contact pressure element 78*b* by way of the second bearing pin 85 is mounted on the respective lateral support body 54 so as to be pivotable about a second pivot axis 79. Each second bearing pin 85 is disposed so as to be eccentric to the second contact pressure element 78*b*, or to the central axis 72*b* of the latter, respectively. Each second contact pressure element 78*b* forms a second contact pressure cam.

In each case one second pivoting means 80*b* in the form of a compression spring, in particular in the form of a coil compression spring, is located between a second support face 89 and an adjacent second engagement face 91.

Figure 8:
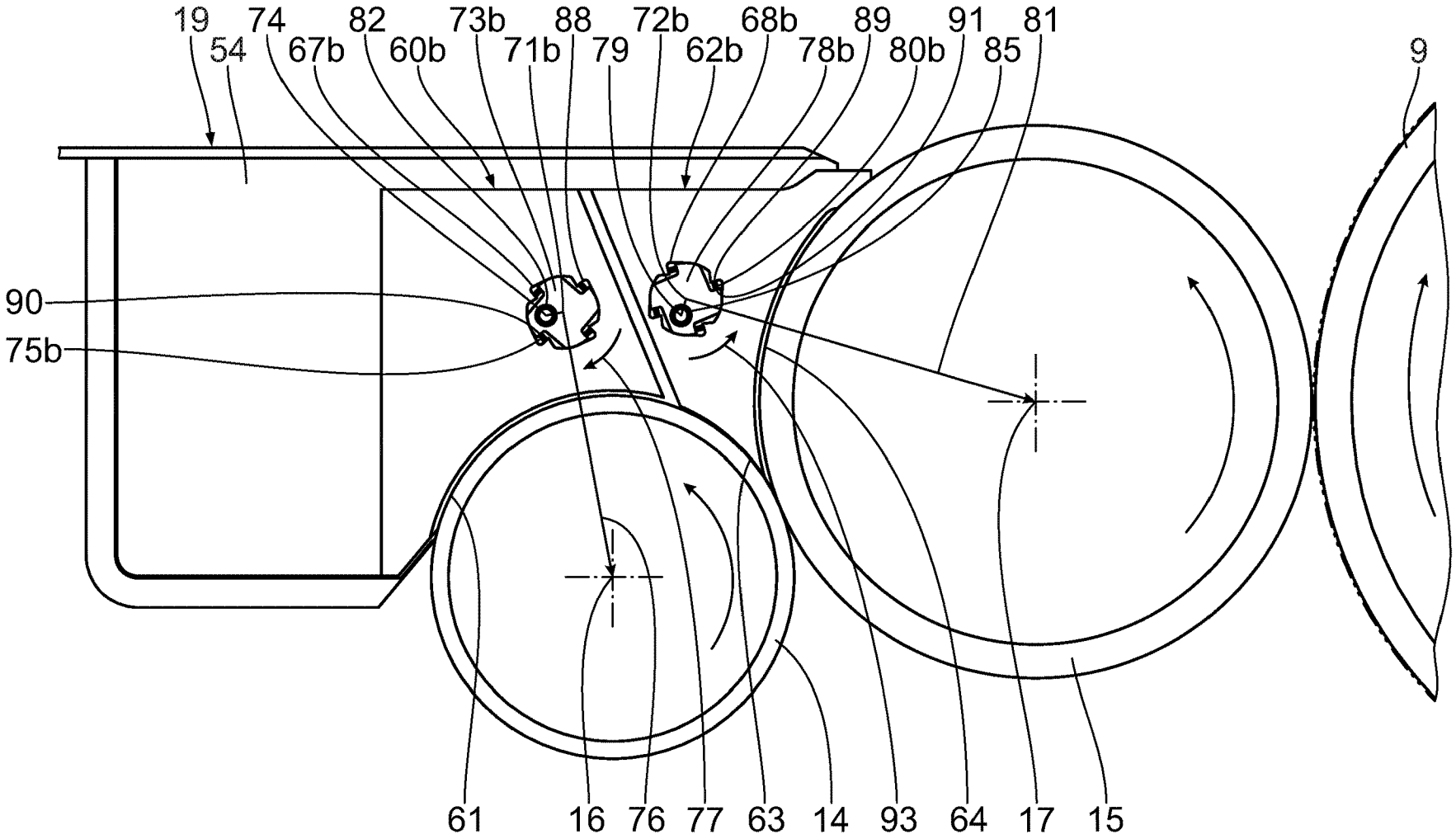
FIG. 8 shows a simplified lateral view corresponding to that of FIG. 3 of a glue application installation according to the invention, according to a third embodiment.
Figure 9:
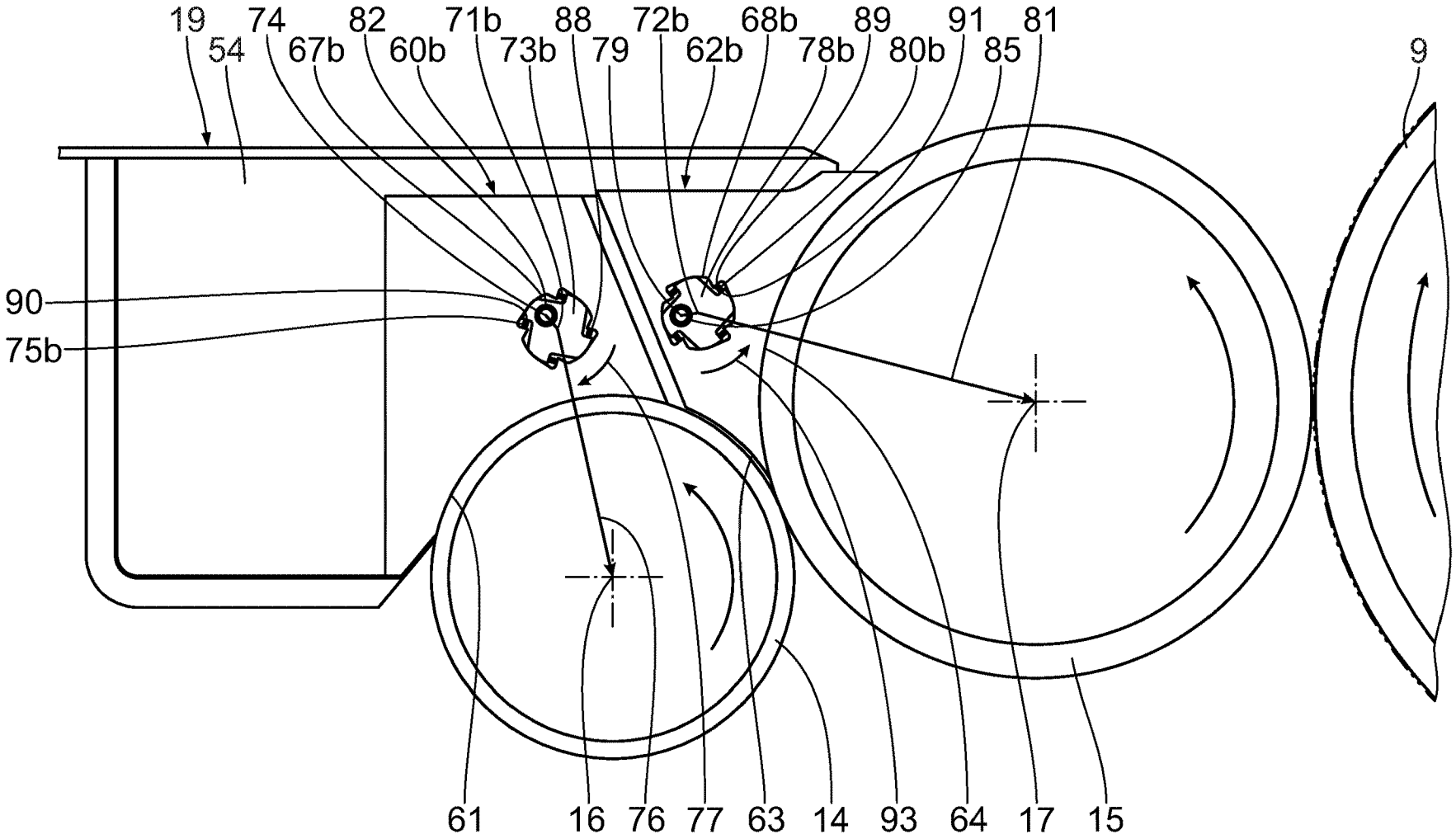
FIG. 9 shows a lateral view corresponding to that of FIG. 8, wherein the glue dam sealing elements are illustrated in a worn state.

As is shown in FIG. 8, the glue metering roller sealing edge 61 is disposed in a sealing manner circumferentially on the glue metering roller 14 such that the first glue dam sealing element 60*b* seals in relation to the glue metering roller 14. The first pivot axis 74 is located laterally approximately at the height of the first central axis 71*b* of the first contact pressure element 73*b*. The first glue dam sealing element 60*b* is in a new, non-worn state.

According to FIG. 8, the glue metering roller termination edge 63 is disposed so as to be slightly spaced apart from the glue metering roller 14. The glue application roller sealing edge 64 is disposed in a sealing manner circumferentially on the glue application roller 15 such that the glue application roller sealing edge 64 seals in relation to the glue application roller 15. The second pivot axis 79 is located in a lower region of the second bearing opening 68*b*.

The first glue dam sealing element 60*b* is capable of at all times adapting in a self-acting manner to the glue metering roller 14, or of at all times bearing tightly circumferentially on the latter, respectively. Said first glue dam sealing element 60*b* is capable of performing at the same time in a self-acting manner an adjustment of the glue metering roller 14.

The first pivoting means 75*b* exert a first pivoting moment on the first contact pressure element 73*b*. Each first pivoting means 75*b* presses the corresponding assigned first contact pressure element 73*b* about the respective first pivot axis 74. Each first contact pressure element 73*b* thus exerts a resulting first contact pressure force 76 on the first glue dam sealing element 60*b*, said first contact pressure force 76 being directed exactly onto the first rotation axis 16 of the glue metering roller 14. Each first contact pressure element 73*b* thus presses the first glue dam sealing element 60*b* in the direction towards the glue metering roller 14, this leading to a uniform tight bearing of the glue metering roller sealing edge 61 on the glue metering roller 14 (FIG. 9). This holds true also in the worn state of the first glue dam sealing element 60*b*.

The second glue dam sealing element 62*b* is capable of at all times adapting in a self-acting manner to the glue application roller 15, or of at all times bearing tightly circumferentially on the latter, respectively.

The second pivoting means 80*b* exert a second pivoting moment on the second contact pressure element 78*b*. Each second pivoting means 80*b* presses the corresponding assigned second contact pressure element 78*b* about the respective second pivot axis 79. Each second contact pressure element 78*b* thus exerts a resulting second contact pressure force 81 on the second glue dam sealing element 62*b*, said second contact pressure force 81 being directed exactly onto the second rotation axis 17 of the glue application roller 15. Each second contact pressure element 78*b* thus presses the second glue dam sealing element 62*b* in the direction towards the glue application roller 15, this leading to a uniform tight bearing of the glue application roller sealing edge 64 on the glue application roller 15 (FIG. 9). This holds true also the worn state of the second glue dam sealing element 62*b*.

The same applies in an analogous manner to the use of the glue dam seal assemblies 19*b* in the gluing unit 28.

What is claimed is:

1. A glue dam seal assembly for a glue application installation of a corrugated board plant, the glue dam seal assembly comprising:

a support installation comprising a lateral support body comprising a first roller receptacle;

an urging installation comprising an urging element mounted such that the urging element is eccentric on the support installation;

a first glue dam sealing element comprising a circular-arc-shaped sealing edge for tight disposal on a first roller of a glue application installation, the first glue dam sealing element being disposed on the support installation, the first glue dam sealing element being configured to be urged onto the first roller by the urging element of the urging installation; and a second glue dam sealing element for tight disposal on a second roller of the glue application installation, the second glue dam sealing element being disposed on the support installation, wherein the first glue dam sealing element and the second glue dam sealing element are adjustable, in relation to one another, the first glue dam sealing element being configured to be urged in a direction towards a first central axis of the first roller via the urging installation.

2. The glue dam seal assembly according to claim 1, wherein the urging element is pivotally mounted.

3. The glue dam seal assembly according to claim 1, wherein the first glue dam sealing element has an internal first bearing clearance for mounting the first glue dam sealing element on the support installation.

4. The glue dam seal assembly according to claim 1, wherein the first glue dam sealing element is pivotable in relation to the support installation, the urging installation comprising an urging element pivotably connected to the support installation such that the urging element is configured to pivot about a first urging element axis in the direction towards the first central axis of the first roller relative to the support installation and the first glue dam sealing element.

5. The glue dam seal assembly according to claim 1, wherein the second glue dam sealing element has a circular-arc-shaped termination edge for the spaced-apart disposal from the first roller.

6. The glue dam seal assembly according to claim 1, wherein the second glue dam sealing element has a circular-arc-shaped sealing edge for bearing on the second roller.

7. The glue dam seal assembly according to claim 1, wherein the second glue dam sealing element has an internal second bearing clearance for mounting the second glue dam sealing element on the support installation.

8. The glue dam seal assembly according to claim 1, further comprising another urging installation, wherein the second glue dam sealing element is configured to be urged in a direction towards a second central axis of the second roller via the another urging installation.

9. The glue dam seal assembly according to claim 1, wherein the second glue dam sealing element is pivotable in relation to the support installation.

10. The glue dam seal assembly according to claim 1, wherein the first glue dam sealing element and the second glue dam sealing element are disposed so as to be mutually spaced apart from each other.

11. The glue dam seal assembly according to claim 1, wherein the first glue dam sealing element and the second glue dam sealing element are pivotable in relation to one another.

12. The glue dam seal assembly according to claim 1, wherein the first glue dam sealing element and the second glue dam sealing element are disposed beside one another in a common plane.

13. A glue application installation for applying glue to a corrugated material web, the glue application installation comprising:

a first roller, the first roller being one of a glue metering roller, a glue squeegee roller, a glue application roller and a gluing roller;

a second roller; and at least one glue dam seal assembly comprising:

a support installation comprising a lateral support body having a first roller receptacle and a second roller receptacle;

an urging installation comprising an urging element mounted such that the urging element is eccentric on the support installation;

a first glue dam sealing element comprising a circular-arc-shaped sealing edge for tight disposal on the first roller of a glue application installation, the first glue dam sealing element being disposed on the support installation, the first glue dam sealing element being urged in a direction towards a first central axis of the first roller via the urging element of the urging installation;

a second glue dam sealing element comprising a circular-arc-shaped sealing edge for tight disposal on the second roller of the glue application installation, the second glue dam sealing element being disposed on the support installation, wherein the first glue dam sealing element and the second glue dam sealing element are adjustable, in relation to one another.

14. The glue application installation according to claim 13, further comprising:

a second glue dam seal assembly to provide a plurality of glue dam seal assemblies for setting a gluing region of the corrugated material web, the urging installation further comprising another urging element mounted such that the another urging element is eccentric on the support installation, the second glue dam sealing element being urged in a direction towards the second roller via the another urging element of the urging installation.

15. The glue dam seal assembly according to claim 1, wherein the second glue dam sealing element is capable of sealed disposal on the first roller and the second roller.

16. A glue dam seal assembly for a glue application installation of a corrugated board plant, the glue dam seal assembly comprising:

a support installation comprising a lateral support body having a first roller receptacle and a second roller receptacle;

an urging installation comprising an urging element mounted such that the urging element is eccentric on the support installation;

a first glue dam sealing element movably connected to a first area of the support installation such that the first glue dam sealing element is movable relative to the support installation in a direction of a first roller, the first glue dam sealing element being configured to be urged in a direction towards a first central axis of the first roller via the urging element of the urging installation;

a second glue dam sealing element movably connected to a second area of the support installation such that the second glue dam sealing element is movable relative to the support installation and the first glue dam sealing element in a direction of a second roller, wherein the first glue dam sealing element and the second glue dam sealing element are movable independent of each other, the first area being located at a spaced location from the second area.

17. The glue dam seal assembly according to claim 16, wherein the first glue dam sealing element and the second glue dam sealing element are located on one side of the support installation.

18. The glue dam seal assembly according to claim 17, further comprising:

a first urging element pivotably connected to the support installation such that the first urging element is configured to pivot about a first urging element pivot axis in the direction towards the first central axis of the first roller relative to the support installation and the first glue dam sealing element to contact the first glue dam sealing element and move the first glue dam sealing element in the direction of the first roller; and a second urging element pivotably connected to the support installation such that the second urging element is configured to pivot about a second urging element pivot axis relative to the support installation and the second glue dam sealing element to contact the second glue dam sealing element and move the second glue dam sealing element in the direction of the second roller, the first urging element pivot axis being parallel to the second urging element pivot axis.

19. The glue dam seal assembly according to claim 16, wherein the first glue dam sealing element is located adjacent to the second glue dam sealing element.

20. The glue dam seal assembly according to claim 16, wherein the urging element is formed as a contact pressure cam.

21. The glue dam seal assembly according to claim 16, wherein the urging element is pivotally mounted.

22. The glue dam seal assembly according to claim 1, wherein the urging element is formed as a contact pressure cam.

23. The glue application installation according to claim 13, wherein the urging element is formed as a contact pressure cam.

24. The glue application installation according to claim 13, wherein the urging element is pivotally mounted.

* * * * *